US006623868B1

(12) United States Patent
Shindou et al.

(10) Patent No.: US 6,623,868 B1
(45) Date of Patent: Sep. 23, 2003

(54) GALVANIZED STEEL FOR USE IN VEHICLE BODY

(75) Inventors: Hidetoshi Shindou, Hyogo (JP); Kiyokazu Isizuka, Hyogo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/129,382

(22) PCT Filed: Oct. 31, 2000

(86) PCT No.: PCT/JP00/07636

§ 371 (c)(1),
(2), (4) Date: May 3, 2002

(87) PCT Pub. No.: WO01/34874

PCT Pub. Date: May 17, 2001

(30) Foreign Application Priority Data

Nov. 5, 1999 (JP) ..... 11-315009

(51) Int. Cl.[7] ..... B32B 15/00; B32B 15/04

(52) U.S. Cl. ..... 428/659; 428/628; 428/472.3

(58) Field of Search ..... 428/659, 628, 428/472.3

(56) References Cited

U.S. PATENT DOCUMENTS 5,152,849 A 10/1992 Bittner et al. ..... 148/262
5,330,850 A * 7/1994 Suzuki et al. ..... 428/659

FOREIGN PATENT DOCUMENTS

DE 198 08 755 9/1999
EP 0 711 849 5/1996

* cited by examiner

*Primary Examiner*—Robert R. Koehler
(74) *Attorney, Agent, or Firm*—Wenderoth, Lind & Ponack, L.L.P.

(57) ABSTRACT

A galvanized steel plate for use in a vehicle body, having corrosion resistance and workability that are well-balanced and being suitable for outer plates of a vehicle body is provided. The plate includes a galvanized steel plate having a zinc coating plated on both surfaces thereof; a zinc phosphate coating layer formed on one of the surfaces of the plate that serves as an outer surface of a vehicle body; and a phosphate-containing composite coating formed on the other of the surfaces that serves as an inner surface of a vehicle body, the composite coating being composed of a zinc phosphate coating layer and a phosphate coating containing Mg. The phosphate-containing composite coating preferably contains 2 wt % or more of Mg, and is preferably applied in an amount greater than or equal to 0.5 g/m$^2$.

8 Claims, No Drawings

GALVANIZED STEEL FOR USE IN VEHICLE BODY

TECHNICAL FIELD

The present invention mainly relates to galvanized steels for use in a vehicle body, and more particularly, to a galvanized steel for use in outer plates of a vehicle body that has improved corrosion resistance and workability. In this specification, a vehicle typically implies an automobile.

BACKGROUND ART

Requirements concerning corrosion resistance and workability of steel plates for use in vehicle bodies are becoming more demanding. In respect of corrosion resistance, pitting presents a significant problem. Pitting often occurs in a door hem portion, which is the area where steel plates meet together. Since paint is not applied to this area in general, corrosion resistance without coating is particularly important for the steel plate in this area. In order to improve the corrosion resistance therefor, a specific type of coated steel plate is widely used, wherein the plate is plated with Zn—Ni alloy to form a relatively thin (20 to 30 g/m$^2$) layer and has an additional chromate or organic coating formed thereover. Although the thus obtained steel plate has sufficient corrosion resistance and workability, the steel plate suffers a problem that the insulative organic coating layer formed as the outer layer often causes unevenness in painting when the plate is painted by means of electro-deposition. This makes it difficult to achieve uniform appearance in terms of painting. Another problem with such plates is that they use expensive nickel and contain hazardous chromium (VI). Galvanized steels with increased amounts of pure zinc, or galvanized steels with Zn—Fe alloy are also available. Although increasing the applied amount of plating can improve corrosion resistance of steel plates, it generally decreases their workability. Thus, it is extremely difficult to balance the two properties.

In an effort to overcome the above-described problems, the present inventors have previously proposed a method of forming an outer layer on a galvanized steel, or on a galvanized steel which has a layer of a zinc-phosphate containing synthetic coating formed thereon, by applying an aqueous solution of magnesium dihydrogenphosphate and subsequently drying the applied solution to form the outer layer. Although good corrosion resistance as well as improved workability can be obtained through this approach, it may not be ideal, given that the plates are intended for use in outer plates of vehicles. Namely, regarding the outer plates for vehicle bodies, different properties are required for the surface that serves as an outer surface of a vehicle body from the surface that serves as an inner surface of the vehicle body: High corrosion resistance to prevent the above-described pitting problem is generally required for inner surfaces while a match with paints and chipping resistance are more important than the corrosion resistance on outer surfaces. While the method previously proposed by the present inventors provides the plates with sufficient pitting or corrosion resistance, it may not provide sufficient chipping resistance, depending on conditions under which the vehicles are painted or subjected to use.

DISCLOSURE OF THE INVENTION

The present invention addresses to solve the above-mentioned problems. Accordingly, it is an object of the present invention to provide a coating structure suitable for use with a steel plate for outer plates of vehicles, the coating having corrosion resistance and workability that are well-balanced.

In one aspect, the present invention provides a galvanized steel for use in a vehicle body, including a galvanized steel plate having a zinc coating plated on both surfaces thereof; a zinc phosphate coating formed on one of the surfaces of the plate that serves as an outer surface of a vehicle body; and a phosphate-containing composite coating formed on the other surface of the plate that serves as an inner surface of a vehicle body, the composite coating being composed of a zinc phosphate coating layer and a phosphate coating layer containing Mg. The phosphate-containing composite coating preferably contains 2 wt % or more of Mg, and is preferably applied to the plate in an amount greater than or equal to 0.5 g/m$^2$.

The present invention will now be described in detail by exemplary examples which are to be construed as illustrative, rather than restrictive.

Galvanizing processes used in the present invention is not specifically limited, and both pure zinc galvanization and alloy galvanization can be adopted to take advantages of their capability to provide good corrosion resistance and improved workability. Galvanizing processes such as electrogalvanizing, hot dipping, or alloy hot dipping are particularly preferred in terms of manufacturing cost. Also, galvanization may be either single-layered or multiple-layered, or it may be applied over a pre-plated layer formed of Ni, Cu, or the like.

A layer of zinc phosphate coating is formed on a galvanized steel on each of the opposite surfaces of the plate, one surface serving as an inner surface of a vehicle body and the other surface serving as an outer surface of a vehicle body. Zinc phosphate coating used to form a layer over the galvanization layer of the steel plates may be those that are commonly used, and the coatings can be formed by using commercially available treatment solutions containing zinc ions, phosphate ions, or the like. The amount of the zinc phosphate coating applied is preferably in a range from about 0.3 g/m$^2$ to about 2 g/m$^2$ under normal conditions. When the coating is applied in an amount less than the lower limit of the range, the corrosion resistance and workability may become insufficient, whereas the amount exceeding the upper limit of the range often makes welding of the plates difficult. Since zinc phosphate coating is typically applied by dipping or spraying, it is difficult to control the amounts of the coating so that the coating is applied in different amounts on the outer surface and the inner surface of the plate. Though the same amount of the coating may be applied to each surface of the plate, a smaller amount (e.g., 0.1–1.5 g/m$^2$) is preferably applied to the surface that serves as an outer surface of a vehicle body than the amount applied to the other surface of the plate that serves as an inner surface of a vehicle body when it is possible to control the amounts of coatings applied, for example, by separately spraying onto each surface, so that different amounts of coating are applied on the opposite surfaces. Even for outer surface, however, it is undesirable to apply no coatings as it not only makes welding difficult but also reduces workability due to the difference in slidability between the opposite surfaces. At least about 0.1 g/m$^2$ of the coating needs to be applied for outer side.

In terms of corrosion resistance and workability, the zinc phosphate coating preferably contains one or more selected from the group consisting of Ni, Mn, Mg, Co, Ca, Cu, and Al. In such a case, steel plates are treated in a bath of a zinc phosphate treatment solution containing the metal ions described above. Also, the composition of the zinc phosphate coating applied to the surface that serves as an outer surface of a vehicle may or may not be the same as that of the zinc phosphate coating applied to the other surface of the plate that serves as an inner surface of the vehicle.

A phosphate coating containing Mg can be formed on the surface that serves as an inner surface of a vehicle body by applying an aqueous phosphate solution containing Mg over the above-mentioned zinc phosphate coating and subsequently drying the solution. This results in the formation of a composite phosphate coating composed of the zinc phosphate coating and the Mg-containing phosphate coating laminated on the zinc phosphate coating. As a result, excellent pitting and corrosion resistance is achieved on the surface that serves as an inner surface of a vehicle body. The coating which is formed by applying an Mg-containing aqueous phosphate solution followed by drying the applied solution, is necessary only on the surface that serves as an inner surface of a vehicle body and not essential on the surface that serves as an outer surface of a vehicle body. Formation of the above-mentioned coating on the outer surface may reduce the chipping resistance of the surface. The coating may preferably be applied to the plate surface that serves as an inner surface of a vehicle body in an amount greater than, or equal to, 0.5 g/m$^2$, which is the total amount in the composite phosphate coating which is composed of the zinc phosphate coating and the coating formed by applying an aqueous phosphate solution containing Mg and then drying it. A preferred content of Mg in the composite phosphate coating is 2 wt % or more. Good corrosion resistance is achieved when these conditions are met. The maximum amount of the composite phosphate coating to be applied, as a total, is preferably 2.5 g/m$^2$ or less in terms of workability.

Preferably, an aqueous solution of $Mg(H_2PO_4)_2$ is used as the Mg-containing phosphate solution. A commercially available solution of magnesium dihydrogenphosphate (e.g., available from Yoneyama Kagaku Kogyo Co., Ltd.) is most preferably used as the Mg-containing phosphate solution for its wide application. These solutions are applied only to one surface (i.e., inner surface) with, for example, a roll coater (coating roller) and are subsequently dried to form a composite phosphate coating.

BEST MODES FOR CARRYING OUT THE INVENTION

EXAMPLES

Examples of the present invention will now be presented hereinbelow. The invention, however, is not limited to the examples.

Sample Preparation

Examples 1 to 5 and Comparative Examples 1 to 3

An electro-galvanized steel plate with a thickness of 0.7 mm, to which 30 g/m$^2$/side of plating materials had been applied by electro-galvanization, was used as a substrate. The surfaces of the plate were conditioned (using Pl—Zn from Nihon Parkerizing Co., Ltd.), and the surfaces were then sprayed with a zinc phosphate treatment solution (zinc ion: 0.7 g/l, nickel ion: 2.0 g/l, phosphate ion: 6.5 g/l, nitrate ion: 6 g/l, fluorides: 0.2 g/l) available from Nihon Parkerizing Co., Ltd. The applied amount of the zinc phosphate coating was adjusted to 1 g/m$^2$ on either side of the plate by adjusting the time during which the surfaces were treated. Following the zinc phosphate treatment, each side of the plate was separately applied an aqueous solution of magnesium dihydrogenphosphate that was diluted to the concentration of 8%. The plate was heated and dried at a temperature of 110° C. and then allowed to cool down. In each of Examples 1 through 5, the plate was applied a coating only to the surface that serves as an inner surface of a vehicle, whereas coatings were applied on both surfaces of the plates in Comparative Examples 2 and 3. Neither surface was coated in Comparative Example 1. The dry weight of the magnesium dihydrogenphosphate coating applied was adjusted by controlling the number of revolutions of the roll coater. For each of the surfaces that were applied a magnesium dihydrogenphosphate coating, the weight of the composite phosphate coating was adjusted as shown in Table.1. The plates were each applied a rust-proof oil (Noxrust 530F60 from Parker Industries. Inc.,) and were left for one day before put to the evaluation procedures described below.

Sample Preparation

Examples 6 and 7

Plates were treated in the same manner as in the example above except that a zinc phosphate coating (1.2 g/m$^2$) containing about 4 wt % of Mg was formed on either surface of the plates. The coating solution was prepared by adding magnesium nitrate to a zinc phosphate treatment solution as described in the example above, such that the solution contains 30 g/l of Mg. An aqueous solution of magnesium dihydrogenphosphate was applied only to the surface of each plate that was to serve as an inner surface of a vehicle body to form a composite phosphate coating with the applied amounts shown in Table.1 below.

Evaluation Procedures

Applied amounts of composite phosphate coating: The applied amounts of the composite phosphate coatings were determined using sample plates sized 40 mmϕ. Each sample with the opposite surface being masked by a sealing tape was immersed in a chromate solution to remove the coating. The applied amount of composite phosphate coating was determined for each sample by subtracting the weight of the sample after removal of the coating from the weight of the sample before removal of the coating.

Mg content (%) in the composite phosphate coating: Mg content (%) in the coating was determined by performing an ICP analysis on the chromate solution obtained above in which the coating had been dissolved.

Chipping resistance: 70×150 mm samples were first processed by basic degreasing, and then by chemical processing for automobiles, which was followed by application of three-layered coating for automobiles (cation electro-deposition 20 μm, intermediate coating 35 μm, outer coating 35 μm). Each sample was cooled to −20° C. and stone pebbles sized about 5 mm were shot to the sample at a right angle with the total amount of 500 g and with a pressure of 3 kgf/cm$^2$. The coatings that came off the surface were removed with a cutter knife, and the total area of the region where the coating peeled was determined using image analysis. The degree of peeling was graded for each sample as follows: x=over 500 mm$^2$, Δ=200~500 mm$^2$, ○=100~200 mm$^2$, and ◎=less than 100 mm$^2$.

Corrosion resistance: Samples were washed with a commercially available washing oil. A U-shaped bead working was performed on each sample (sample width=70 mm, BHF=1 ton, height of working=70 mm, R of punch in bead portion=5 mm, R of die in bead portion=3 mm, R of punch=5 mm, R of die=5 mm, working speed=25 spm). One side (die side) of the sample was cut out and degreased. The sample was then masked by cellophane adhesive tape on the end surfaces and back surface. CCT test* was conducted on the samples and the degree of rusting was observed after ten cycles of the test. The degree of rusting was graded for each sample as follows: ⊙=0%, ○=less than 1%, Δ=1~10%, and X=more than 10%. (*CCT test: One cycle of the test includes spraying salt water (5% NaCl, 35) for 6 hours, drying (50° C. 45% RH) for 3 hours, moisturizing (50° C. 95% RH) for 14 hours, and drying (50° C. 45% RH) for 1 hours. The cycle was repeated.)

Workability: Samples were washed with a commercially available washing oil. The LDR (limit drawing ratio) values were measured using a multi-purpose deep-drawing test instrument. The samples were pressed with BHF of 1 ton and with a punch radius of 40 mmϕ. The surface that was to serve as an inner surface of a vehicle body was punched. The LDR value was graded for each sample as follows: x=LDR value less than 2.0, Δ=2.0~2.2, ○=2.2~2.3, and ⊙=greater than 2.3.

The results are shown in Table 1 below. The samples that did not satisfy the conditions in accordance with the present invention exhibited deterioration in some of the above-described properties.

TABLE 1

| | No. | Surface which serves as an outer surface: Applied amount of Magnesium dihydrogen phosphate (g/m²) | Chipping resistance | Surface which serves as an inner surface: Applied amount of phosphate composite coating (g/m²) | Mg % | Corrosion resistance | Workability |
|---|---|---|---|---|---|---|---|
| Example | 1 | 0 | ⊙ | 1.5 | 3.0 | ⊙ | ○ |
| | 2 | 0 | ⊙ | 2.0 | 4.5 | ⊙ | ○ |
| | 3 | 0 | ⊙ | 2.2 | 4.9 | ⊙ | ○ |
| | 4 | 0 | ⊙ | 1.2 | 1.5 | ○ | ○ |
| | 5 | 0 | ⊙ | 1.5 | 3.0 | ⊙ | ○ |
| | 6 | 0 | ⊙ | 1.4 | 4.7 | ⊙ | ⊙ |
| | 7 | 0 | ⊙ | 1.4 | 4.7 | ⊙ | ⊙ |
| Comparative Example | 1 | 0 | ⊙ | 1.0 | 0.0 | X | Δ |
| | 2 | 0.5 | Δ | 1.5 | 3.0 | ⊙ | ○ |
| | 3 | 0.9 | X | 2.2 | 4.9 | ⊙ | Δ |

Sample Preparation

Examples 8 to 10 and Comparative Example 4

Plates were applied 0.5 g/m² of zinc phosphate in the same manner as in Examples 1 to 5 described above. Subsequently, the plates were each applied an aqueous solution of magnesium dihydrogenphosphate diluted to the concentration of 8%, using a roll coater, only to the surface that was to serve an inner surface of a vehicle body. Each plate was heated and dried at a temperature of 110° C. and was then allowed to cool down. The samples for Experiments 8 to 10 and Comparative Experiment 4 were prepared by varying the applied amounts of the coatings. The plates were each applied a rust-proof oil (Noxrust 530F60 from Parker Industries. Inc.,) and were left for one day before put to the evaluation procedures described below.

Sample Preparation

Examples 11 and 12 and Comparative Example 5

Samples were prepared in the same manner as in the above-described examples except that 0.2 g/m² of the zinc phosphate coatings were applied.

Evaluations were made in the same manner as in the above-described examples.

The results are shown in Table 2 below. Besides, numbers are presented only for the workability and corrosion resistance of the inner surfaces, since every sample showed good "⊙" in chipping resistance for the outer surfaces. The samples that did not satisfy the conditions in accordance with the present invention exhibited deterioration in corrosion resistance.

TABLE 2

| No. | Surface which serves as an inner surface: Applied amount of phosphate composite coating (g/m²) | Mg % | Corrosion resistance | Workability |
|---|---|---|---|---|
| Example | | | | |
| 8 | 0.7 | 2.6 | ⊙ | ○ |
| 9 | 0.9 | 4.0 | ⊙ | ○ |
| 10 | 1.2 | 5.3 | ⊙ | ○ |
| 11 | 0.6 | 6.0 | ⊙ | ○ |
| 12 | 0.9 | 7.0 | ⊙ | ○ |

TABLE 2-continued

| No. | Surface which serves as an inner surface: Applied amount of phosphate composite coating (g/m²) | Mg % | Corrosion resistance | Workability |
|---|---|---|---|---|
| Comparative Example | | | | |
| 4 | 0.6 | 1.7 | Δ | ○ |
| 5 | 0.4 | 4.5 | x | ○ |

Industrial Applicability

The present invention provides a galvanized steel that has properties required of outer plates for use in vehicles, in good balance. The steel plates in accordance with the present invention have been improved in various properties. They are also free of hazardous substances such as chromium (VI). It is also advantageous that the plates of the present invention can be manufactured in a simple and cost-effective manner. Accordingly, the steel plates in accordance with the present invention are suitable for use in a vehicle body.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A galvanized steel for use in a vehicle body, comprising:

a galvanized steel plate having a zinc coating plated on both surfaces thereof;

a zinc phosphate coating formed on one of the surfaces of the plate which serves as an outer surface of a vehicle body; and a phosphate-containing composite coating formed on the other of the surfaces that serves as an inner surface of a vehicle body, the composite coating being composed of a zinc phosphate coating and a phosphate coating containing Mg.

2. The galvanized steel according to claim 1, wherein the phosphate-containing composite coating contains 2 wt % or more of Mg, and is applied to the plate in an amount greater than or equal to 0.5 $g/m^2$.

3. The galvanized steel according to claim 1, wherein the phosphate coating containing Mg is formed by applying an aqueous solution of magnesium dihydrogenphosphate and then drying the applied solution.

4. The galvanized steel according to claim 1, wherein the zinc phosphate coating contains one or more selected from the group consisting of Ni, Mn, Mg, Co, Ca, Cu, and Al.

5. The galvanized steel according to claim 2, wherein the phosphate coating containing Mg is formed by applying an aqueous solution of magnesium dihydrogenphosphate and then drying the applied solution.

6. The galvanized steel according to claim 2, wherein the zinc phosphate coating contains one or more selected from the group consisting of Ni, Mn, Mg, Co, Ca, Cu, and Al.

7. The galvanized steel according to claim 3, wherein the zinc phosphate coating contains one or more selected from the group consisting of Ni, Mn, Mg, Co, Ca, Cu, and Al.

8. The galvanized steel according to claim 5, wherein the zinc phosphate coating contains one or more selected from the group consisting of Ni, Mn, Mg, Co, Ca, Cu, and Al.

* * * * *